US011154890B2

(12) United States Patent
Tezino, Jr.

(10) Patent No.: US 11,154,890 B2
(45) Date of Patent: Oct. 26, 2021

(54) UNDERGROUND SPRINKLER SYSTEM

(71) Applicant: Donald Ray Tezino, Jr., Spring, TX (US)

(72) Inventor: Donald Ray Tezino, Jr., Spring, TX (US)

( * ) Notice: Subject to any disclaimer, the term of this patent is extended or adjusted under 35 U.S.C. 154(b) by 672 days.

(21) Appl. No.: 14/637,392

(22) Filed: Mar. 3, 2015

(65) Prior Publication Data

US 2016/0256887 A1 Sep. 8, 2016

(51) Int. Cl.
*B05B 12/04* (2006.01)
*B05B 15/74* (2018.01)

(52) U.S. Cl.
CPC ..... *B05B 12/04* (2013.01); *B05B 15/74* (2018.02)

(58) Field of Classification Search
CPC ..... B05B 15/74; B05B 12/04
USPC ..... 239/201
See application file for complete search history.

(56) References Cited

U.S. PATENT DOCUMENTS 4,453,749 A * 6/1984 McKinnon ..... F16L 35/00 285/390
4,456,034 A * 6/1984 Bixby ..... F16L 11/118 138/103
4,669,508 A * 6/1987 Neaves ..... B29D 23/006 138/121
4,765,541 A * 8/1988 Mangels ..... A01G 25/023 239/201
5,039,011 A 5/1991 Parker
5,242,112 A * 9/1993 Dunn ..... B05B 15/654 239/203

* cited by examiner

*Primary Examiner* — Chee-Chong Lee
(74) *Attorney, Agent, or Firm* — Delphine James

(57) ABSTRACT

An improved underground sprinkler system having pop-up sprinklers installed within specifically arranged underground trenches. The kit comprises a flow control member that attaches to the water faucet can be manually or automatically switched between water zones where the underground sprinkler are placed.

16 Claims, 18 Drawing Sheets

Kit Package #1 with One Zone No Timer

- 1- Y Fitting – Fig. 1
- 1- Back Flow Preventer – Fig. 1a
- 1- Swivel Adapter – Fig. 3
- 1- 25' Roll of ½" poly hose – Elongated Pipe Member – Fig. 5
- 1- Elbow – Connector Member – Fig. 4
- 1- 2" Poly Nipple – Fig. 7a
- 1- ½" Poly Adapter – Fig. 7
- 1- ¾" x ½" Reducer – Fig. 6
- 1- Gear Drive Sprinkler Head "Streamer" – Fig. 8c

FIG. 16A

Kit Package #2 One Zone and Two Sprinkler No Timer

- 1- Y Fitting – Fig. 1
- 1-Back Flow Preventer – Fig. 1a
- 1- Swivel Adapter – Fig. 3
- 1- 100' Roll of ½" Poly Pipe – Fig.5
- 1- Elbow – Connector Member – Fig. 4
- 1- Tee Fitting – Fig. 4a
- 2- 2" Poly Nipple – Fig. 7a
- 2- ½" Poly Adapter – Fig. 7
- 2- ¾" x ½" Reducer – Fig. 6
- 2- Gear Drive Sprinkler Heads "Streamer" – Fig. 8c Note: Pressure at house faucet has to be 30 psi to 40 psi to properly function.

FIG. 16B

Kit Package #3 One Zone and Single Timer

- 1- Single Timer – Fig. 2
- 1- Y Fitting – Fig. 1
- 1- Back Flow Preventer – Fig. 1a
- 1- Swivel Adapter Fig. 3
- 1- 50' Roll of ½" Poly Pipe – Fig. 5
- 1- Elbow – Fig. 4
- 1- 2" Poly Nipple – Fig. 7a
- 1- ½" Poly Adapter –Fig. 7
- 1- ¾" x ½" Reducer – Fig. 6
- 1- Gear Drive Sprinkler Head "Streamer" – Fig. 8c

FIG. 16C

Kit Package #4 One Zone, Two Sprinkler Heads and a Single Timer

- 1- Single Timer – Fig. 2
- 1- Back Flow Preventer – Fig. 1a
- 1- Swivel Adapter Fig. 3
- 1- Roll of 100' Poly Pipe – Fig. 5
- 1- Elbow – Fig. 4
- 1- Tee Fitting – Fig. 4a
- 2- Poly 2" Nipple – Fig. 7a
- 2- ½" Poly Adapter – Fig. 7
- 2- ¾" x ½" Reducer – Fig. 6
- 2- Gear Drive Sprinkler Head "Streamer" – Fig. 8c

FIG. 16D

Kit Package #5 Three Zones with Three Port Timer

- 1- Three Port Timer – Fig. 2
- 1- Y Fitting – Fig. 1
- 1- Back Flow Preventer – Fig. 1a
- 3- Swivel Adapters
- 3- Elbows – Fig. 4
- 3- Rolls of 50' Poly Pipe – Fig. 5
- 3- 2" Poly Nipples – Fig. 7a
- 3- ½" Poly Adapters – Fig. 7
- 3- ¾" x ½" Reducers – Fig. 6
- 3- Gear Drive Sprinkler Heads " Streamer" – Fig. 8c

FIG. 16E

Kit Package #6 One Zone with Single Timer

- 1- Single Timer – Fig. 2
- 1- Y Fitting – Fig. 1
- 1- Back Flow Preventer – Fig.1a
- 1- Swivel Adapter Fig. 3
- 1- Roll of 50' ½" Poly Pipe – Fig. 5
- 1- Elbow – Fig. 4
- 1- 2" Poly Nipple – Fig. 7a
- 1- ½" Poly Adapter – Fig. 7
- 1- ¾" x ½" Reducer – Fig. 6
- 1- Spinaroonie – Fig. 8d

FIG. 16F

UNDERGROUND SPRINKLER SYSTEM

This patent claims the benefit of provisional application 61/868,415 and Ser. No. 14/465,813

BACKGROUND OF THE INVENTION

This invention relates to underground lawn sprinkler systems, more specifically this relate to a kit and a method of installing an underground lawn sprinkler system. Conventional underground sprinkler systems connected to a home's main water supply lines are utilized to provide irrigation water to lawns, gardens and shrubbery. The primary advantage of such sprinkler systems is their lack of visibility when the system is not operating since the pipes interconnecting the sprinkler nozzles are concealed underground and the sprinkler nozzles themselves are generally positioned flush with the surface of the ground. The nozzles utilized with underground sprinkler systems generally rise above the surface of the ground when the sprinkler is operating and return to their flush position when water flow is terminated.

Conventional underground sprinkler systems generally are difficult to assemble and require permits. The present system and method provides a simple and efficient underground sprinkler system that is easy to assemble and operate.

SUMMARY OF THE INVENTION

The sprinkler system of the present invention comprises a kit with at least one pop-up along with piping and coupling connections to support the installation of an underground installation sprinkler system. Once assembled the pop-up sprinkler device is installed in specially designed and arranged underground trenches. The kit provided in the present invention comprises a flow control member that attaches directly to the outside home faucet which is then connected to an adapter that is attached to flexible elongated PVC pipe supporting fluid communication into a connected elbow pipe member that is attached to the pop up underground sprinkler housing.

The system can be arranged in multiple zones with multiple underground sprinkler devices with each device having preset spray patterns for distributing water uniformly and efficiently thereby minimizing the number of sprinkler heads used. The present invention does not connect to the household underground water supply.

The present invention further comprises a horizontal trench dug shallow approximately 3 inches underground extending from the water faucet to 24 inches before the installation of the vertical trench which support the underground sprinkler. A tapered trench extends between the ends of the horizontal trench to the end of the vertical trench.

Accordingly, it is a primary objective of the present invention to provide an underground sprinkler system that can be easily and efficiently installed by a home owner without permits.

It is a further object of the present invention to provide a sprinkler system with spray nozzle and sprinkler head so positioned in a retracted, non-sprinkling position, that chances of clogging are greatly reduced.

Other and further objects, as well as various advantages and features of novelty which characterize the invention are pointed out with particularity in the claims annexed hereto and forming a part hereof. However, for a better understanding of the invention, its objectives and advantages obtained by its use, reference should be had to the drawings which form a further part hereof, and to the accompanying descriptive matter in which there is illustrated and described a preferred embodiment of the invention.

BRIEF DESCRIPTION OF THE DRAWINGS

This invention is described by appended claims in relation to description of a preferred embodiment with reference to the following drawings which are described briefly as follows:

FIG. 16 illustrates a plurality of kits that can be used in this invention.

DETAILED DESCRIPTION OF THE INVENTION

Figure 2:
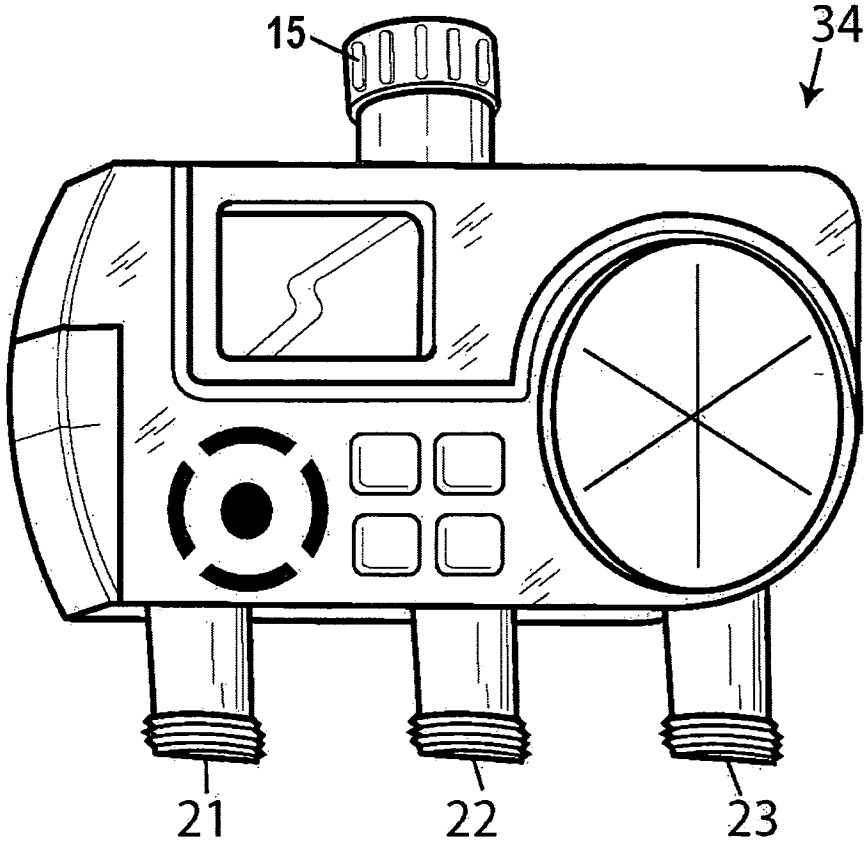
FIG. 2 is a partial cutaway sectional view of the timer connector member.

Referring to the drawings in detail wherein like numerals indicate like element there is shown an underground sprinkler system according to the present invention. Referring to FIG. 11 through 14 there is shown various perspective views of the present invention wherein the kit is installed within the various underground trenches of the present invention. The element of the kit includes (1) flow control member (16) shown in FIG. 1; (2) automatic connector member (34) in FIG. 2; (3) sprinkler members (50) in FIG. 8*a*-8*d*; (4) elongated piping (40) in FIG. 5; (5) the backflow preventor (32) in FIG. 1*a*; (6) the T connector (33) illustrated is FIG. 4*a*; (7) the interconnector or swivel adapter (36) in FIG. 3; and (8) plurality of couplers (42, 45, and 41) in FIGS. 6, 7 and 7*a*. Each of the elements of the kits can be used in various configurations as illustrated in FIG. 16.

Figure 1:
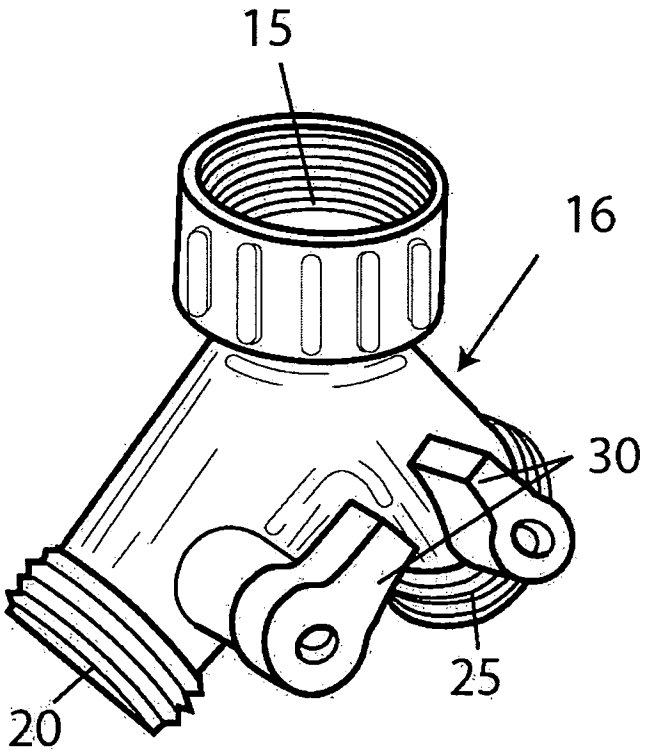
FIG. 1 is a partial cutaway sectional view of the flow control member.

FIG. 1 illustrates the flow control member (16) which allows a user to alternate between water zones to maintain adequate water flow coverage for a section of the lawn. A water zone consists of a group of interconnected underground sprinklers to support the water flow coverage to a section of a lawn of up to 30 feet in the disclosed embodiment. However, the length of the coverage is based upon the size of the streamer of the large pop-up sprinkler. In one embodiment of the present invention, the kit and the underground sprinkler system consists of one large sprinkler along with its flexible elongated pipe and adapter coupler connections therebetween as illustrated in FIG. 16.

Figure 14:
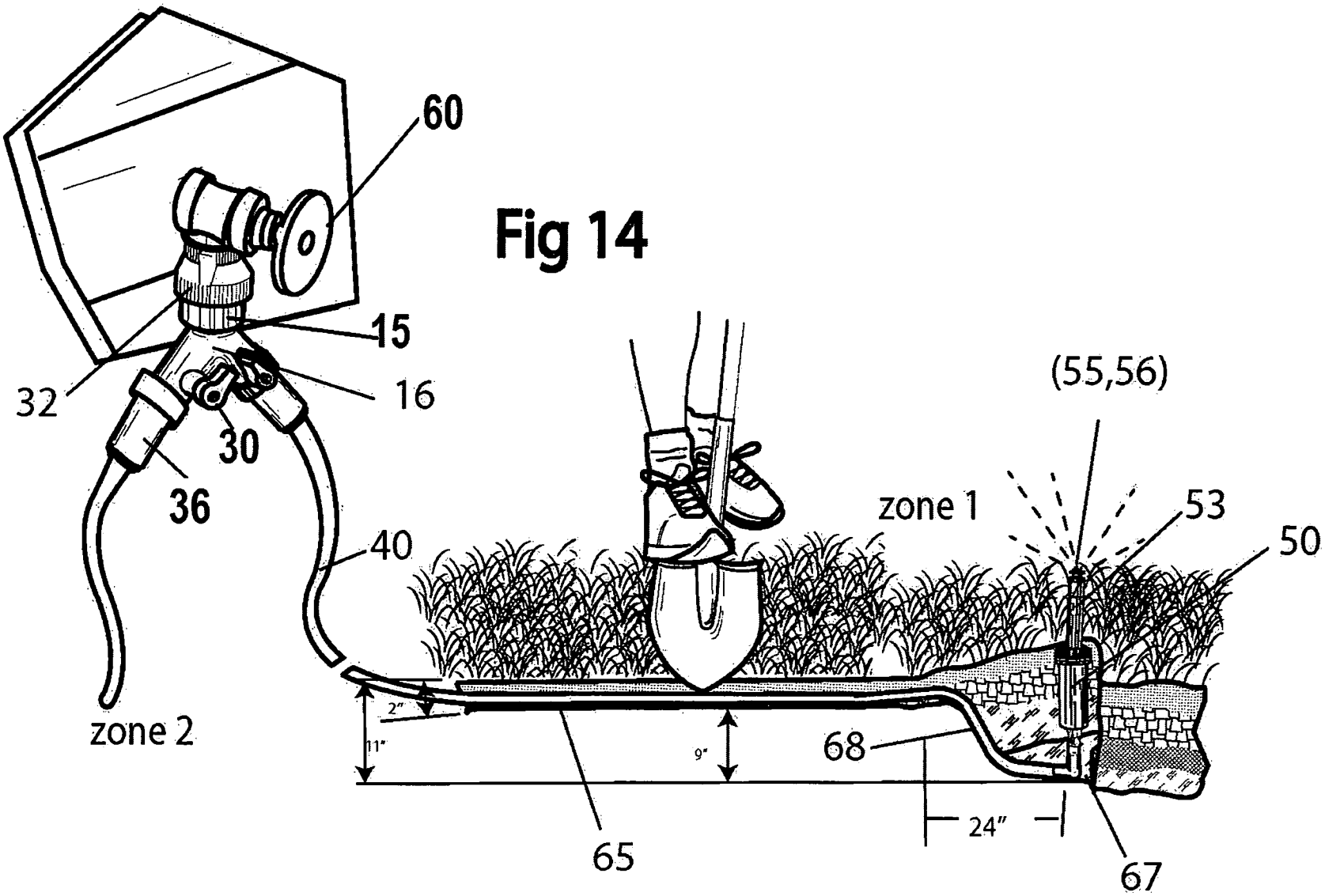
FIG. 14 is a perspective view of the system using the Y connector member.

As depicted in FIG. 14, the flow control member (16) forms the shape of a Y with coupler attaching to the water faucet (60). In this configuration the Y Coupler (16) can be used to manually control water flow between two water zones. In this installed configuration only one zone is implemented. However, a manual configuration of the system is not limited to 1 or 2 water zones but can vary up to four connections or as many connections that can be supported by the flow control member (16). As depicted in FIG. 14 to support one large sprinkler (50) vertical trench (67) is created approximately 30 feet from faucet (60). To support pipe (40) a lateral or horizontal trench (65) is created between the faucet (60) and 24 inches from vertical trench (67). A tapered trench (68) is created to support elbow (35) to provide a constant flow of water to sprinkler (50). In alternative embodiments the sprinkler in FIG. 8*g* is utilized wherein a tapered trench (68) is not required because the elongated pipe (40) interconnects directly within the median opening with the sprinkler (50).

Figure 11:
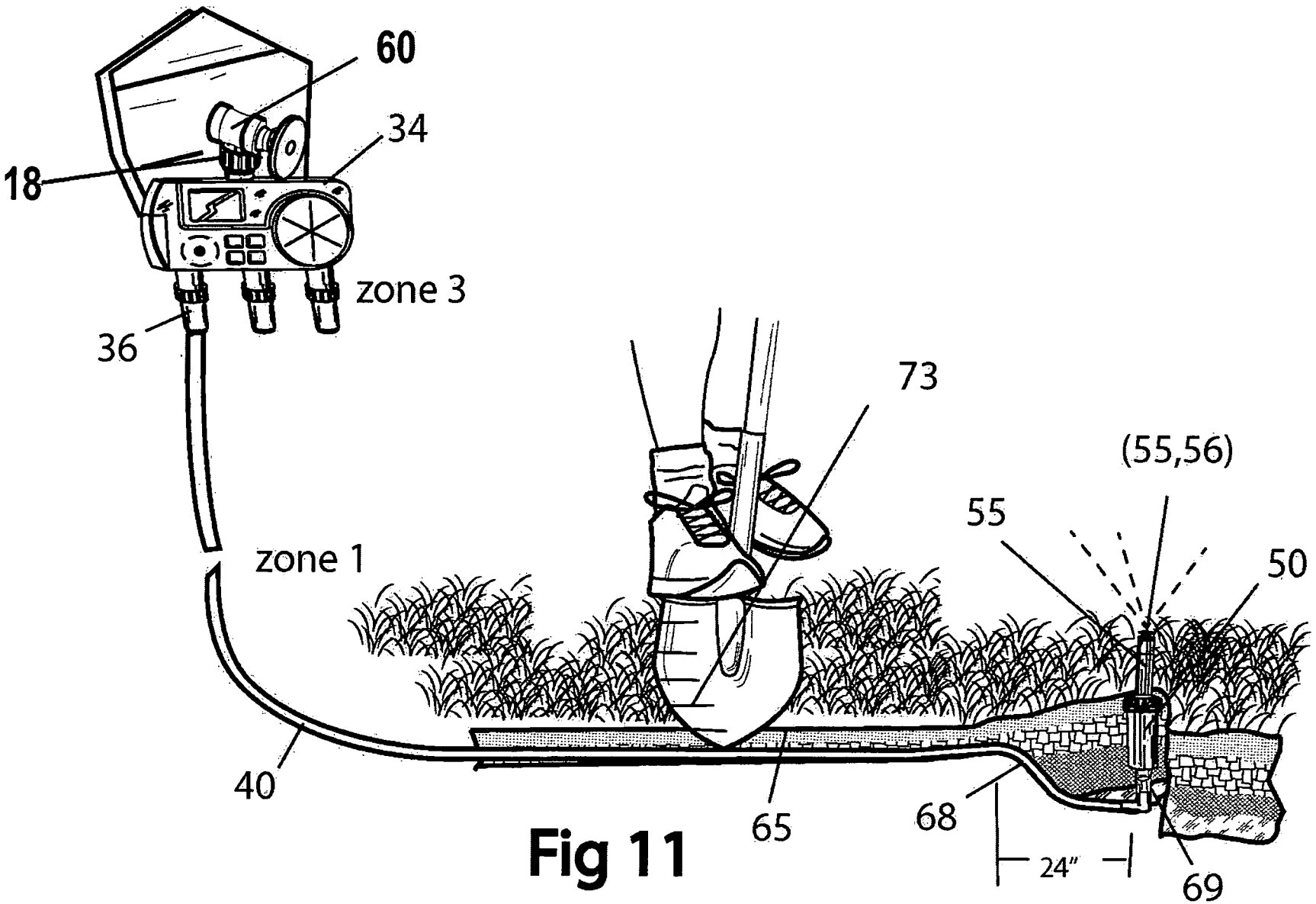
FIG. 11 is a perspective view of the system installed underground.
Figure 12:
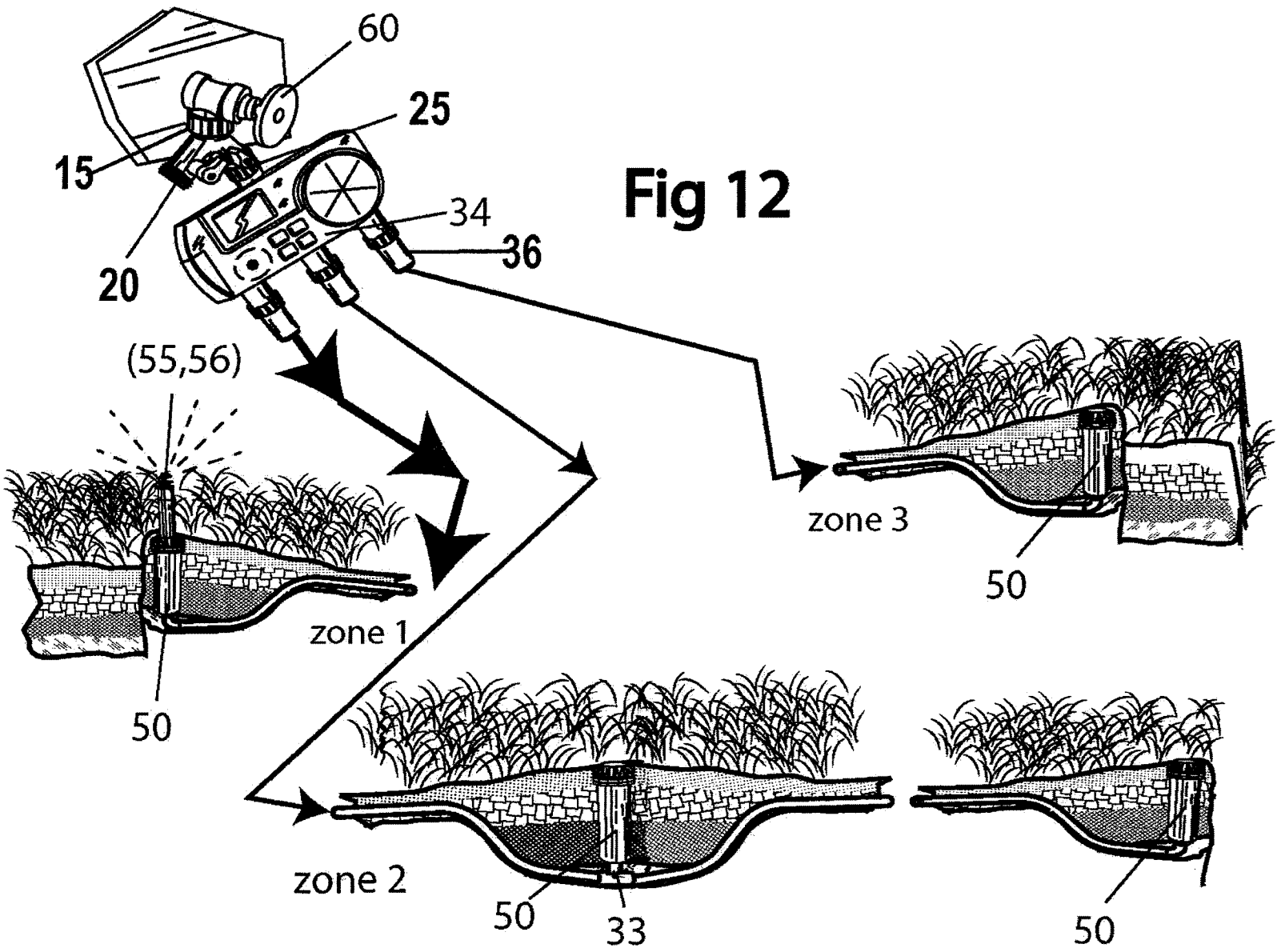
FIG. 12 is a perspective view of the system with multiple zones.
Figure 13:
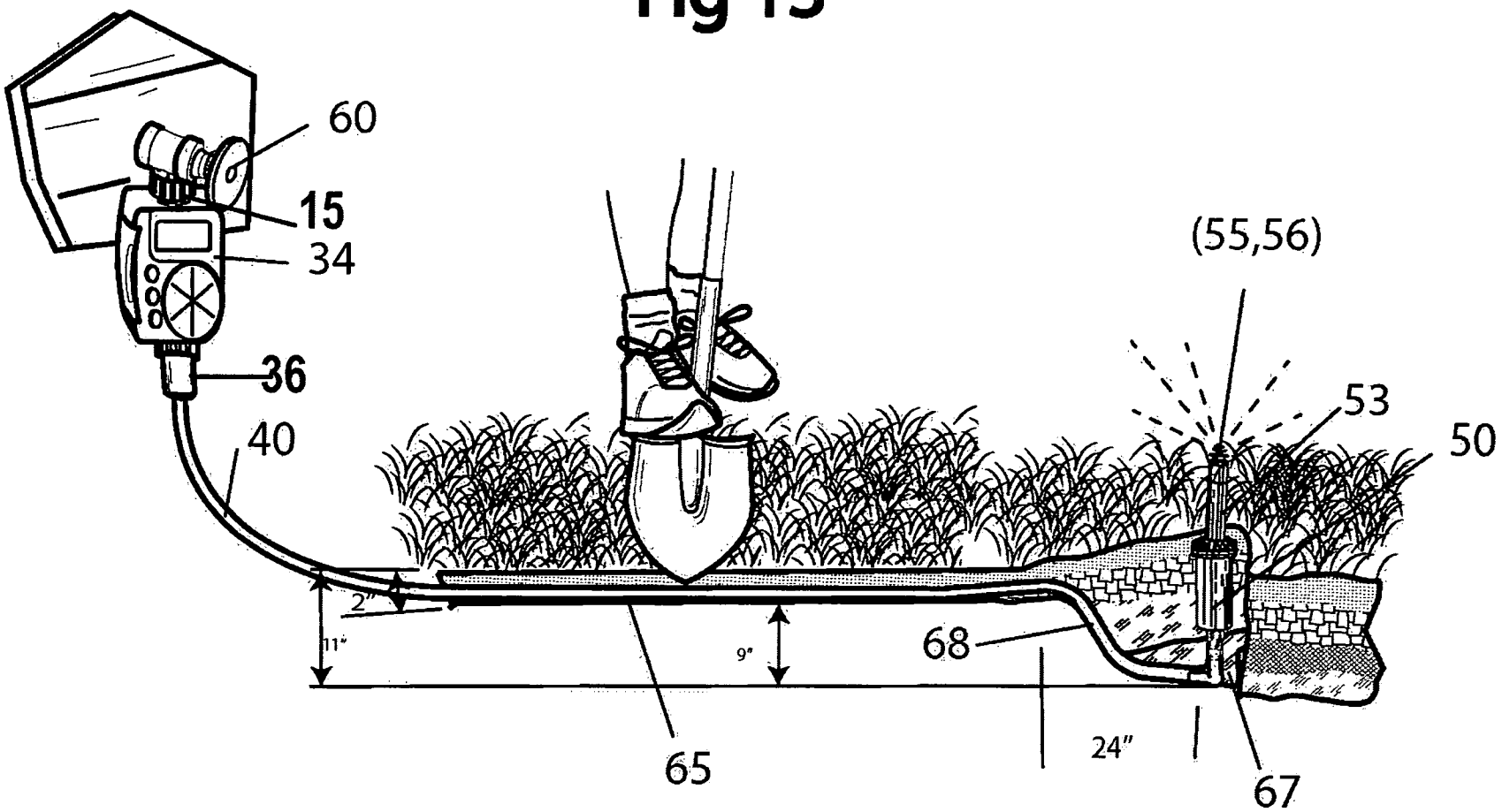
FIG. 13 is a perspective view of the system with a single zone.

Manual switches (30) depicted in FIG. 1 are valves which allow a user to switch between water zones outlet ports on the flow control member (16). As depicted in FIG. 1, outlet ports (20) and (25) attaches to adapter (36) depicted in FIG. 3 which interconnect to the elongated piping (40) which support the underground water flow from the faucet (60) to the underground sprinkler (50) as depicted in FIG. 11-13. Adapter coupler (36) have opposing connections with one side that is attached to the outlet ports (20, 25) and the opposing end interconnecting to the elongated piping (40) wherein fluid communications to the pop-up sprinkler (50) is continuously sustained within a water zone section. Additionally, alternative outlet ports (21, 22, and 23) attached to automatic connector member (34) can be utilized to automatically switch between multiple water zones.

FIG. 2 illustrates one embodiment of an automatic connector member (34), a device, which allows a user to automatically alternate between water zones thereby maintaining adequate water flow coverage for a section of the lawn of a water zone. The user sets timers which automatically control the water flow between alternate zones depicted by outlet ports (21, 22 and 23). This device automatically switches between water zones thereby eliminating user manual interaction via valve switches between water zones.

Figure 9:
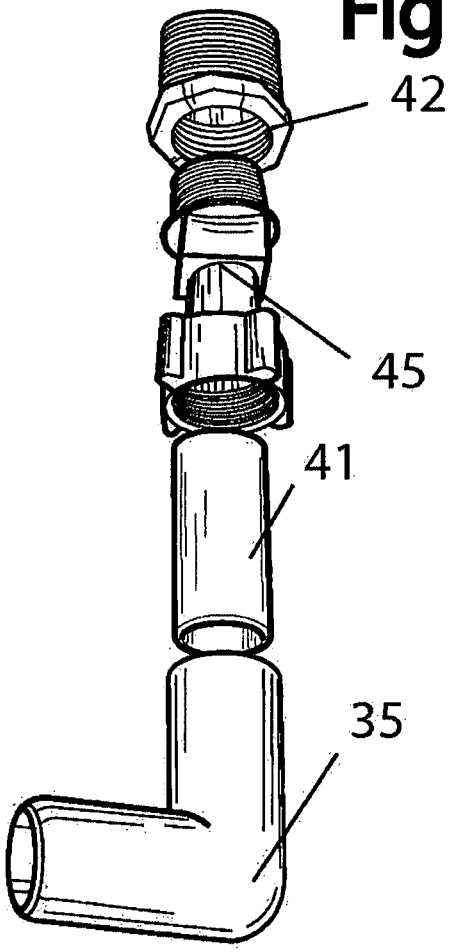
FIG. 9 is a partial cutaway sectional view of the elbow connection of the present invention.
Figure 10:
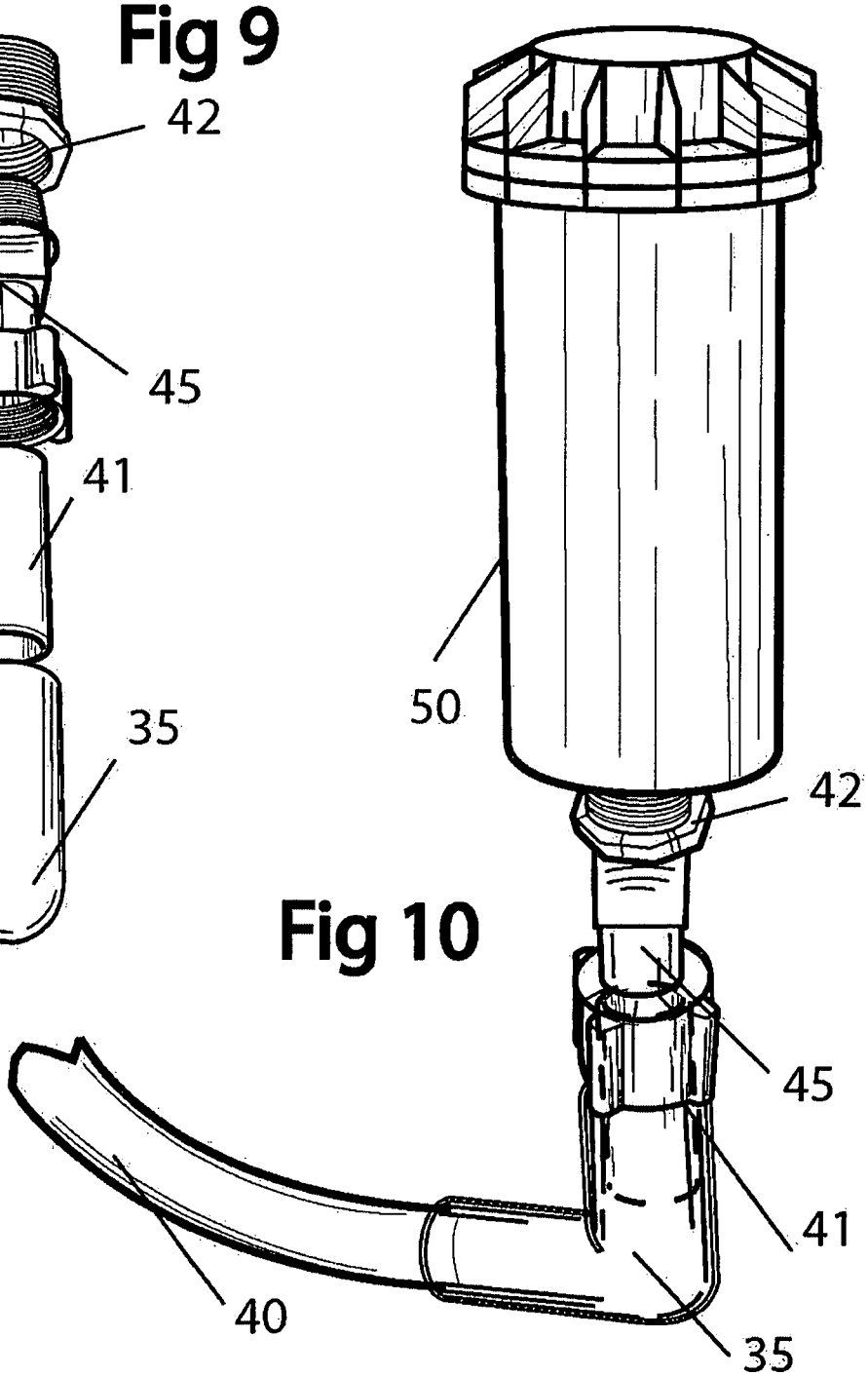
FIG. 10 is a partial cutaway sectional view of the pop up sprinkler connected to the elbow pipe member.

FIGS. 9 and 10 illustrates the plurality of adaptors required to support the interconnection of the piping system where a large sprinkler is utilized. In the illustrated configuration a reducer coupler (42) is required to support a connection to the large sprinkler (50). Elbow pipe (35) depicted in FIGS. 10 and 9 support a 90 degree turn for the final underground sprinkler (50) supporting a water zone as depicted in FIG. 11. The T shape coupler (33) in FIG. 4*a* interconnects multiple sprinklers in a water zone as depicted in FIG. 12. FIG. 9 shows short nipple (41) that interconnects elbow (35) to adapter coupler (45).

Figure 6:
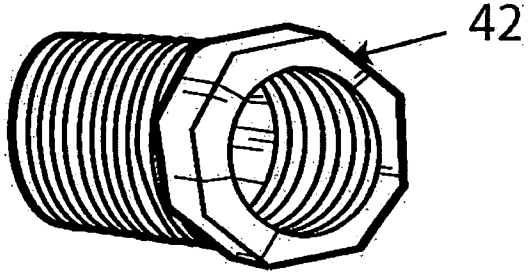
FIG. 6 is a partial cutaway sectional view of the nipple connector member.

FIG. 6 depicts a reducer coupler (42), a short tubular member with opposing male and female connections incorporated thereon. In the disclosed invention, a 1h to % inch reducer is disclosed. As shown in FIG. 10 this is to an internal female connection with opposing male connection that connects with the large pop-up sprinkler (50).

Figure 7:
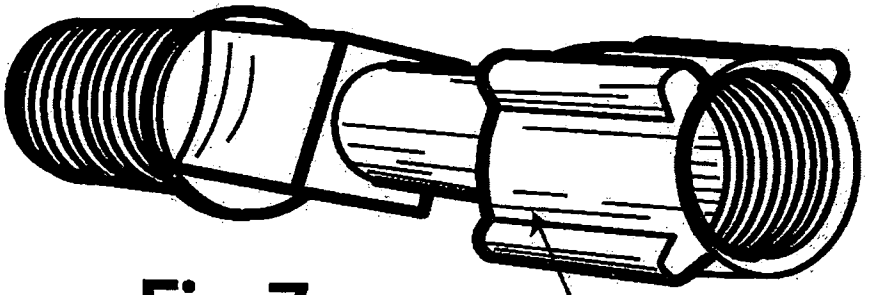
FIG. 7 is a partial cutaway sectional view of the hose coupling member or poly adapter.
Figure 7A:
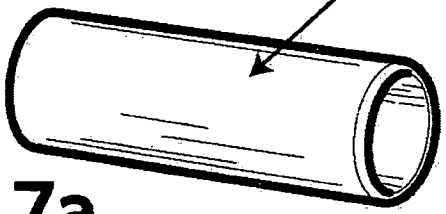
FIG. 7*a* is a partial cutaway sectional view of the nipple.

FIG. 7*a* depicts a nipple (41), a short tubular member without opposing connections with an approximate 2 inches in diameter. FIG. 7 depicts a poly adapter (45) having opposing connection to interfacing with the elongated piping. FIG. 9 illustrates the multiple connectors in the present invention for interconnecting the large pop-up sprinkler (50) to the elongated piping (40).

Figure 4A:
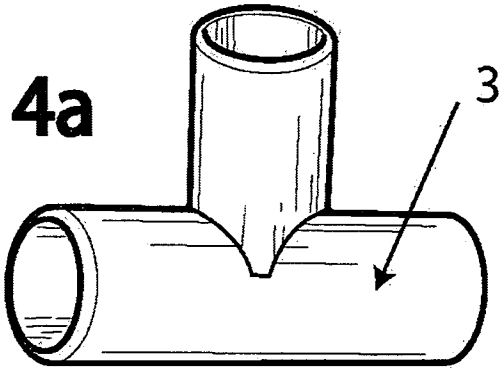
FIG. 4*a* is a partial cutaway sectional view of the T pipe member.

FIG. 4*a* illustrates a T-shape short tubular member (33) having a short vertical tubular member perpendicularly incorporated within a horizontal tubular member forming a T shape. The T shape coupler (33) is utilized to lengthen the linear coverage within a water zone section.

Reducer coupler (42) is used to interconnect a large hose connection to a smaller hose connection. In this system the elongated pipe (40) is ½ inch in diameter and the large hose connection is 2 inches in diameter. Thus, a reducer coupler (42) is (¾"×½") type of connector. In this system the elbow pipe (35) is two inches in diameter and the lower end of the sprinkler (50) is 4 inches in diameter. Thus, a reducer (42) is required. Then, adapter coupler or poly adapter (45) with opposing ends which are used to interconnect the sprinkler (50) to elbow pipe (35). FIGS. 9 and 10 illustrates the connections required to support fluid communication from the elongated pipe (40) to the sprinkler (50).

Figure 5:
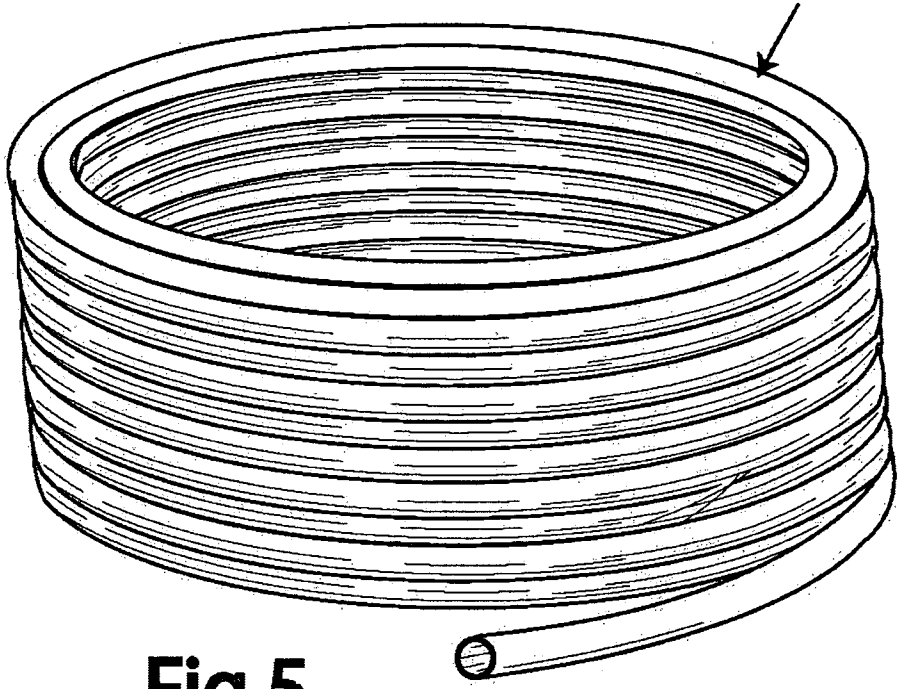
FIG. 5 is a partial cutaway sectional view of the PVC elongated pipe member.

FIG. 5 illustrates elongated piping (40) which interconnects the water supply from faucet (60) to sprinkler (50) as depicted in FIG. 11-14, also as depicted in FIG. 16 the length of the elongated pipe (40) can be changed to support the kit. With this system PVC elongated piping (40) can vary in length, normally 25 to 100 feet depending upon the coverage of the lawn.

Figure 15A:
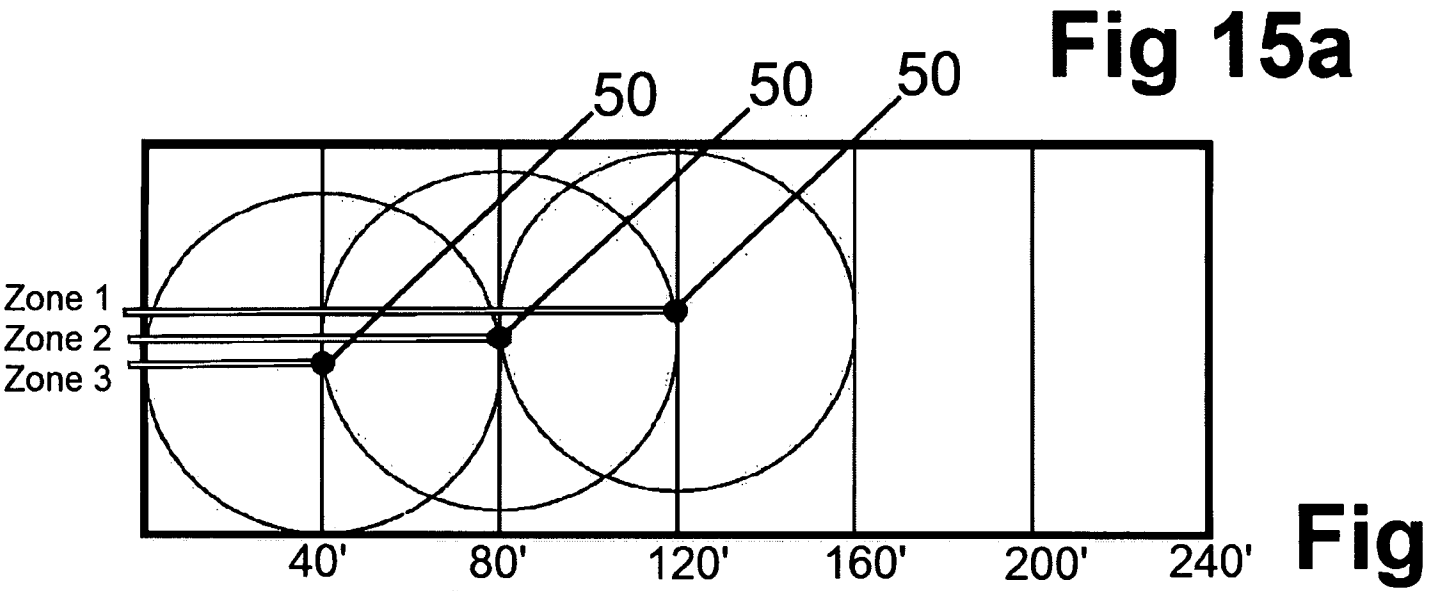
FIG. 15*a* illustrates distances covered by zones.
Figure 15B:
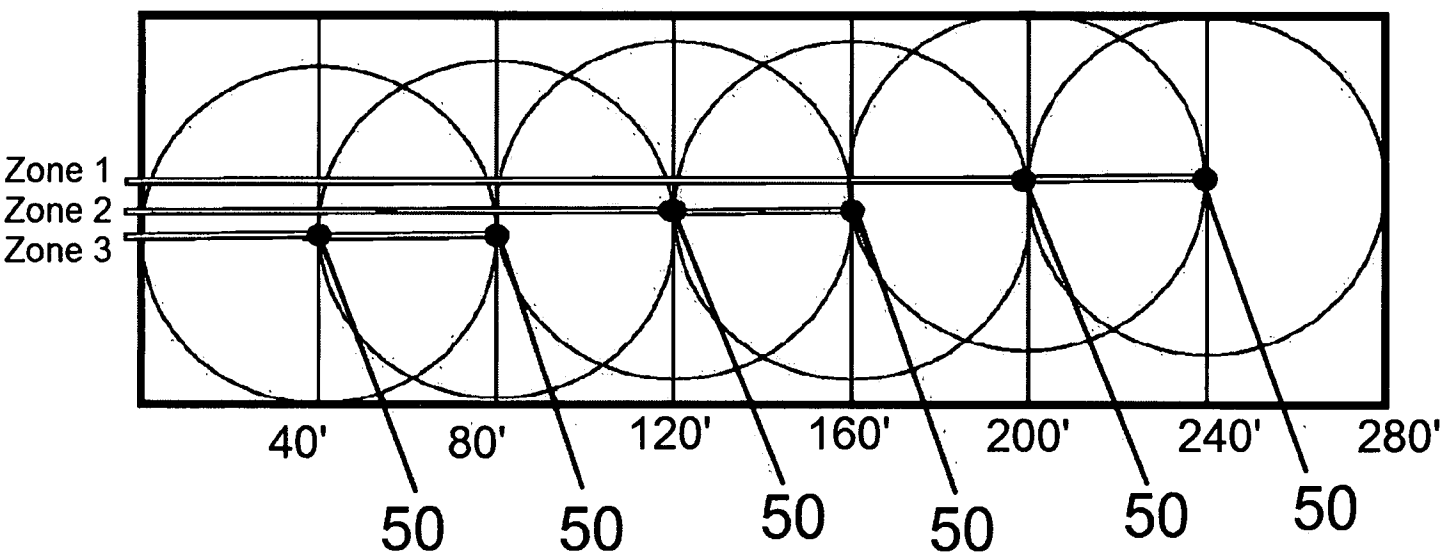
FIG. 15*b* illustrates distances covered by multiple zones.

Pop-up sprinkler (50) can be a conventional sprinkler with risers that telescopically extends above the ground. Sprinklers can range in diameter from 2 to 8 inches in width. The larger the width of the sprinkler head, the wider range the length of spray the sprinkler can support. FIG. 15*a* illustrates a configuration of multiple zones supported by a single large sprinkler which reaches up to 40 feet in length in lawn coverage. As depicted 120 feet could be supported with 3 water zones. In an alternative configuration illustrated in FIG. 15*b* with two large sprinklers (50) in one zone covering 80 feet. As depicted in FIG. 15*b*, 280 feet is covered with 3 zones.

Figures 8A, 8B, 8C, 8D:
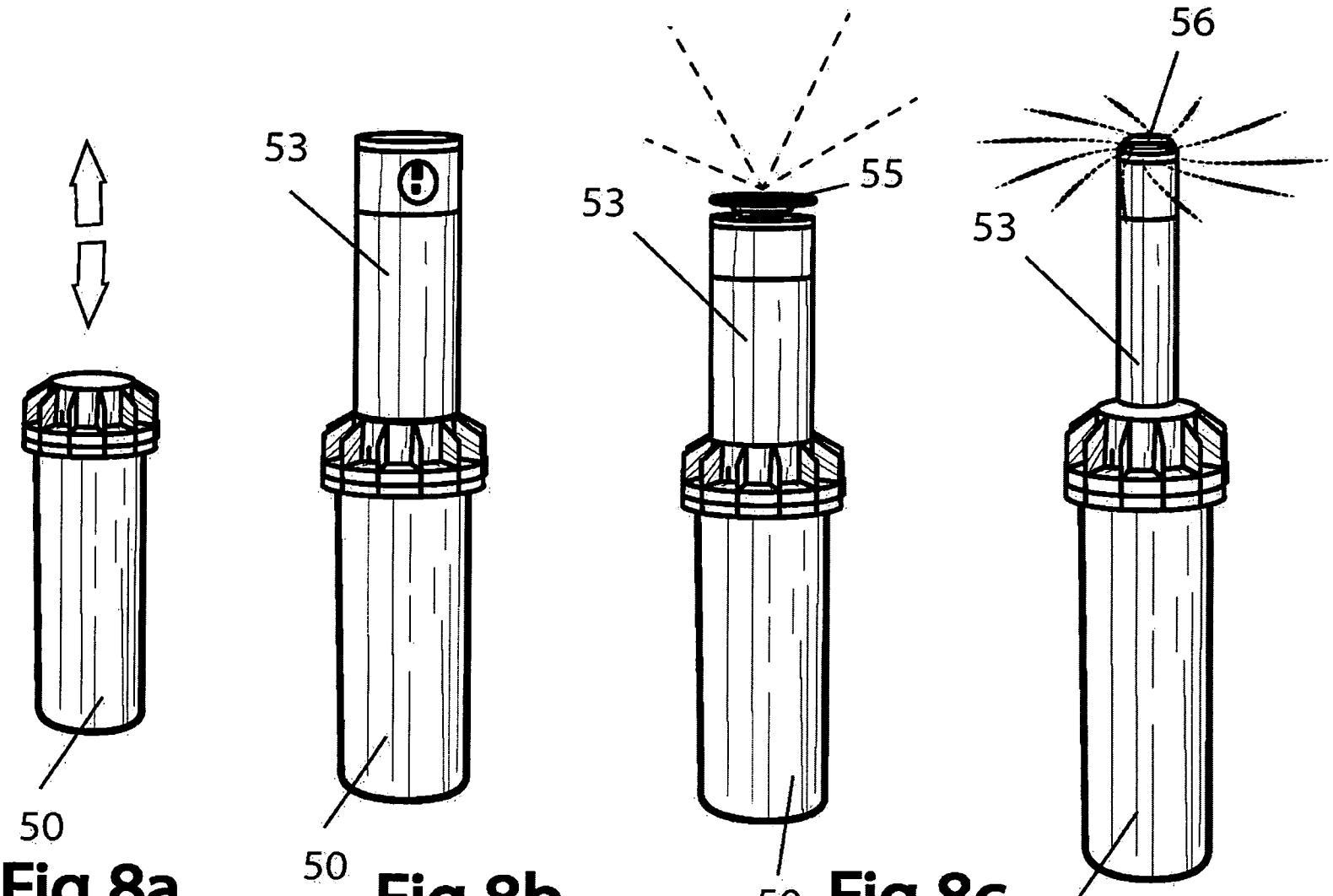
FIGS. 8*a*, 8*b* and 8*c* are partial cutaways sectional view of the pop-up sprinkler in various positions.
FIG. 8*d* is a partial cutaway sectional view of a plurality of small jet stream pop-up sprinklers.
Figure 8F:
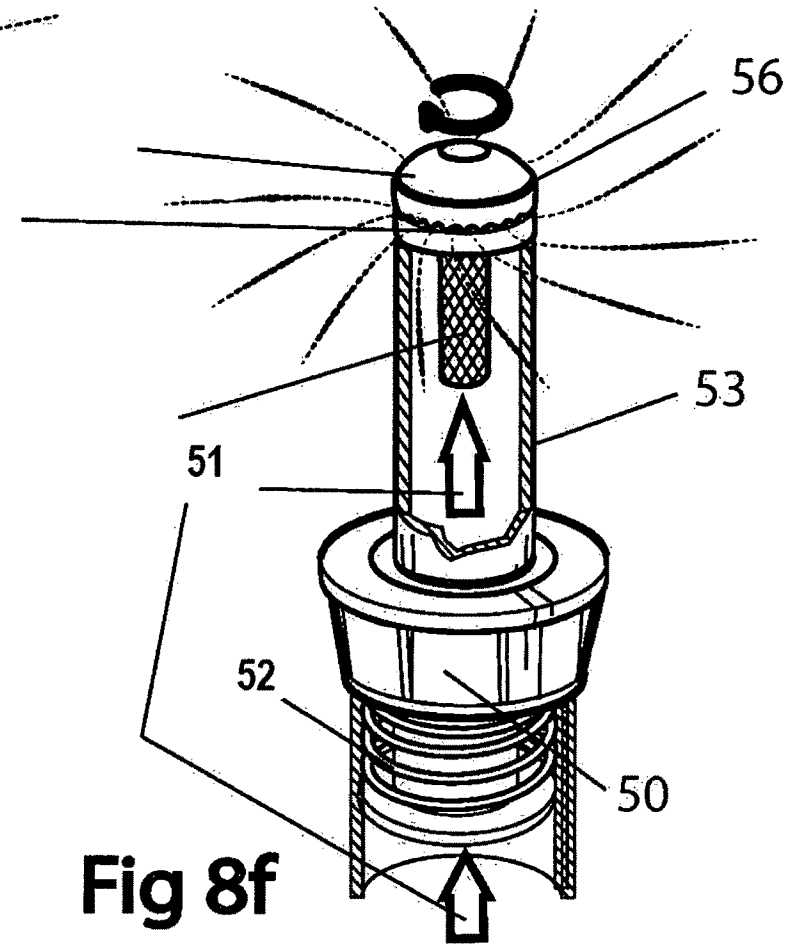
FIG. 8*f* is a partial cutaway sectional view of rotational type of sprinkler.
Figure 8E:
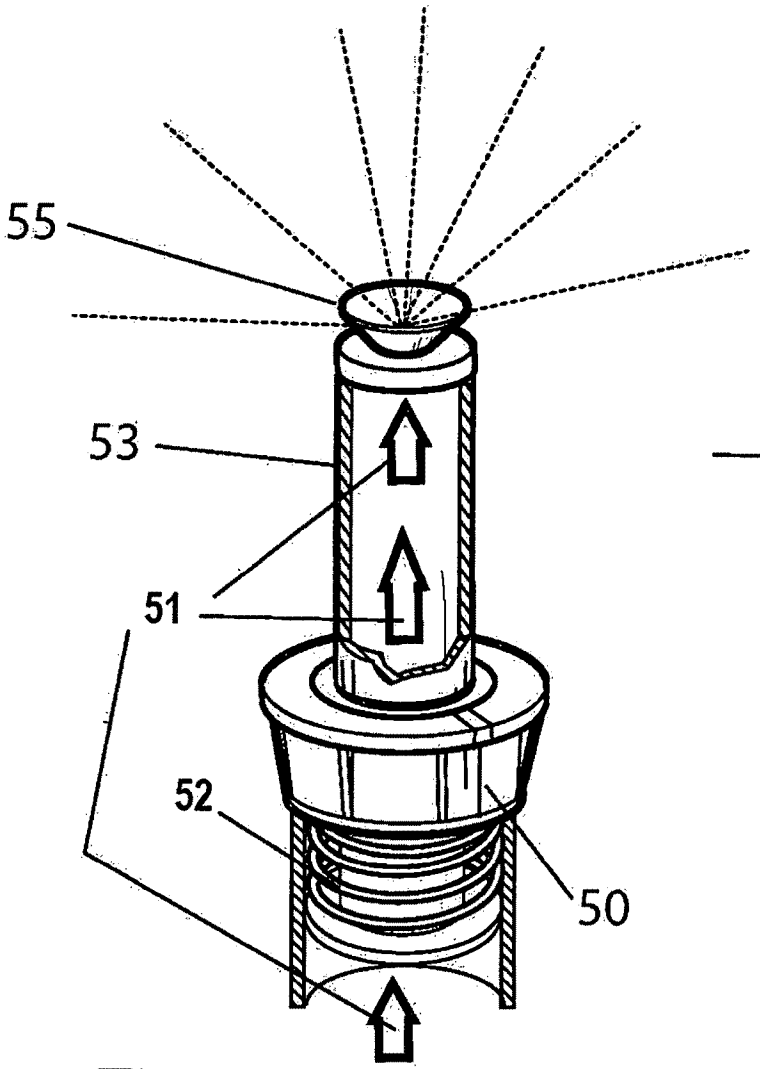
FIG. 8*e* is a partial cutaway sectional view of one type of sprinkler.
Figure 8G:
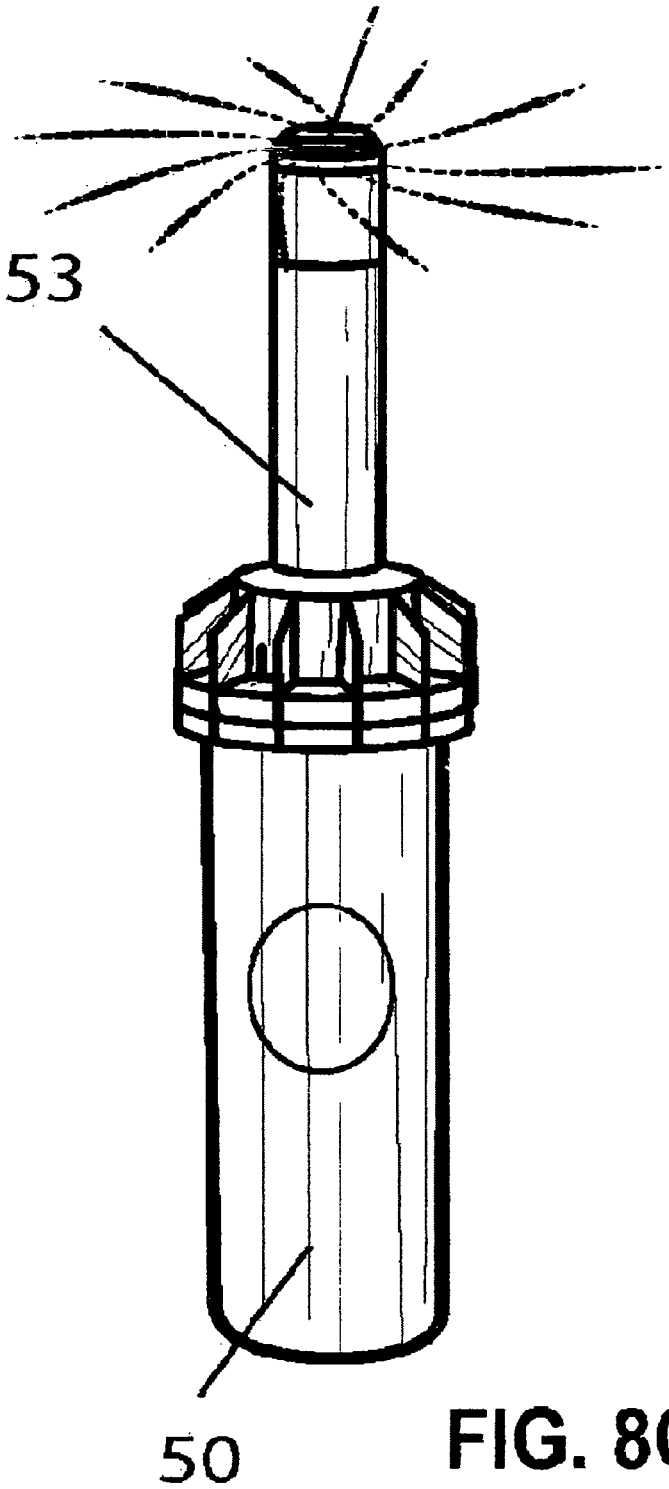
FIG. 8*g* is a partial cutaway sectional view of an alternative rotational type of sprinkler.

Sprinklers water jet streams (55) emitted from the riser (53) can be one large jet stream as depicted in FIGS. 8*c* and 8*e* or smaller 360 degree rotating jet streams (56) as depicted in FIGS. 8*d* and 8*f*. With the embodiment in FIG. 8*d*, a plurality of small outlet ports encircles the top portion of the risers (53) and is in fluid communications with the elongated pipe member (40) wherein the water is emitted from the plurality of small outlet ports as the top (56) rotates 360 degrees as depicted in FIG. 8*f*. This embodiment has the advantage of saving water but still support the coverage. As depicted in FIGS. 8*e* and 8*f*, as the water flows upward spring (52) engages to support water flow (51) upward within riser (53) to (55) and 56 respectively.

Figure 1A:
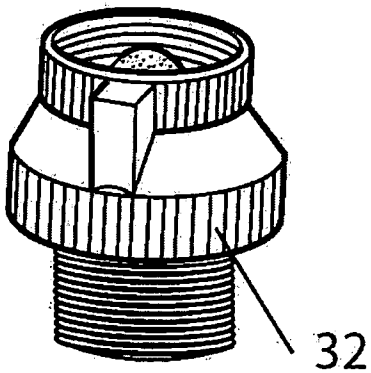
FIG. 1*a* is a partial cutaway sectional view of the backflow preventer.

In the present invention backflow preventer (32) in FIG. 1*a* can be installed between the water faucet (60) and the flow control member (16) or automatic connector member (34) depicted in FIG. 11-14. A backflow prevention device is used to stop foreign material from siphoning back into the main water supply.

FIG. 11-14 illustrates the elements of the kit installed within specifically arranged underground trenches. A horizontal trench (65) is placed three inches below ground level and horizontally extends between water faucet (60) to the a predetermined distance before the underground sprinkler (50). In this system, the predetermined distance is 24 inches before the placement underground sprinkler (50).

In the illustrated embodiment a vertical trench (67) is normally centrally placed on the lawn to support a specific water zone and extends vertically downward to a predetermined depth. In this invention the predetermined depth is 18 inches. A tapering trench (68) extends 11 inches between the end of the horizontal trench (65) and the lower depth of the vertical trench (67). The tapering trench allows the water to flow forward from the water supply and keep constant water pressure within a zone. The vertical trench support the placement of the underground sprinkler configuration depicted in FIGS. 9 and 10 and installed in FIG. 11-13.

To build the three inch horizontal trench (65) in an aesthetically and efficiently manner, a shovel is inserted into the ground three inches and the dirt is slightly flipped over. This process is repeated until the 24 inches before the placement of the underground sprinkler.

FIG. 11 illustrates a kit configuration with a three port automatic timer (34) attached to faucet (60). Zone 1 is shown supported by one large sprinkler which can be FIG. 8C or 8D.

FIG. 12 illustrates a kit configuration Y fitting (16) interconnecting the faucet (60) with the three port automatic timer (34). Zone 1 and zone 3 are shown supported by one large sprinkler which can be FIG. 8C or 8D. Zone two is supported by two sprinklers interconnected by a T fitting (33). FIG. 13 illustrates a single port timer (34) directly connected to the water faucet (60) with coupling (15) supporting one water zone.

FIG. 16 provides a listing of the various permutations of the kits to support sample underground sprinkler systems of the present invention. Each kit is described below.

Kit #1 One Zone Kit with "No Timer".

The contents in this kit will cover up to ninety square feet or 30'×30' feet with one large sprinkler. FIG. 14 illustrates this Kit. To install Kit #1, the following steps are performed. At the house faucet (60) connect the backflow preventer (32) illustrated in FIG. 1*a* directly to the faucet (60) which prevents any siphoning back into the house. Then connect the Y fitting (16) illustrated in FIG. 1 onto the back flow preventer (32) illustrated in FIG. 1*a*. Put a placement flag at the point in the lawn where the large sprinkler will be located. Create a vertical trench near faucet (60) by measuring from the house faucet down three inches into the ground and then create a horizontal trench (65) that extends from the vertical trench (67) until 24 inches before the placement flag. Next attach the swivel adapter (35) illustrated in FIG. 3 onto the y fitting (16) illustrated in FIG. 1. Interconnect the elongated flexible pipe (40) of ½" diameter of at least 25 feet illustrated in FIG. 5 into the swivel adapter (35) illustrated in FIG. 3 by pushing one end of the elongated pipe (40). Place the segmented elongated flexible pipe (40) of at least ½" diameter of at least 25 feet illustrated in FIG. 5 into the horizontal trench (65). Create the assembly in FIG. 9 which interconnects with the sprinkler assembly illustrated in FIG. 10. Next interconnect the other end of the elongated pipe (40) with elbow (35) as shown in FIGS. 9 and 10. Then attach the gear drive sprinkler head streamer (50) illustrated in FIG. 8*b* onto the ¾"×½" reducer (42). Place assembly illustrated in FIG. 10 onto a stake and secure stake into the ground, go to the house faucet (60) and open the valve to allow water to fill the elongated flexible pipe (40).

Kit #2 One Zone with Two Sprinkler Head "No Timer"

Figure 3:
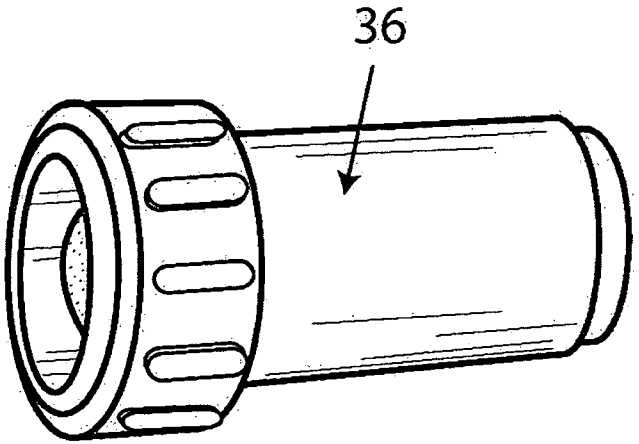
FIG. 3 is a partial cutaway sectional view of the pipe adapter member.
Figure 4:
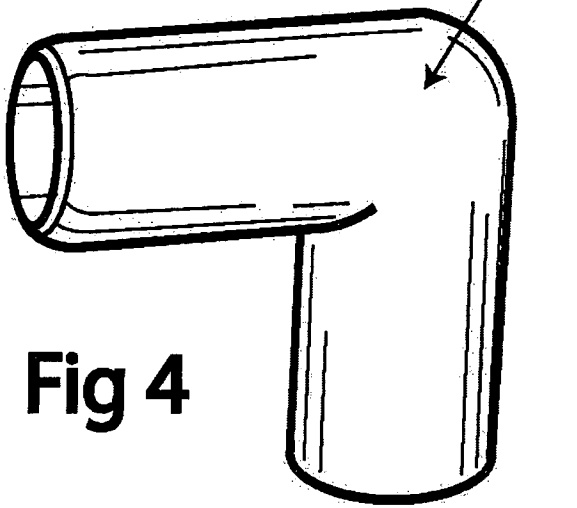
FIG. 4 is a partial cutaway sectional view of the elbow pipe member.

FIG. 12 illustrates one zone with connect the back flow preventer (32) illustrated in FIG. 1*a* to the faucet (60). The connect Y fitting (16) to backflow prevent (32). Then swivel adapter (36) illustrated in FIG. 3 is attached onto the backflow preventor (32). Next measure from the house faucet (60) down into the ground 3" inches and cut the 100' roll of W' inch elongated pipe (40) illustrated in FIG. 5, then push the 100' roll of ½" inch elongated pipe (40) illustrated in FIG. 5 1" inch into the elbow connector member (35) illustrated in FIG. 4, at the other end of the elbow connector member (35) illustrated in FIG. 4 push 1" inch of the 100' roll of ½" elongated pipe (40) illustrated in FIG. 5 into the elbow connector member (35) illustrated in FIG. 4 push 1" inch of the 100' roll of ½" inch elongated pipe (40) illustrated in FIG. 5 into the T fitting (33) illustrated in FIG. 4*a*, this fitting will allow you to add the 100' roll of ½" inch elongated pipe (40) illustrated in FIG. 5 in two directions for sprinkler heads, push 100' roll of ½" inch elongated pipe (40) illustrated in FIG. 5 1" inch into one side of the tee fitting (33) illustrated in FIG. 4*a* and lay down on the ground to the placement of your first sprinkler head, then go back to the tee fitting (33) illustrated in FIG. 4*a* and push 1" inch of the 100' roll of ½" inch elongated pipe (40) illustrated in FIG. 5 into the other end of the tee fitting (33) illustrated in FIG. 4*a* and lay down the 100' roll of ½" inch elongated pipe (40) illustrated in FIG. 5 onto the ground to the placement of the second sprinkler head. At the end of the 100' roll of ½" inch elongated pipe (40) illustrated in FIG. 5 at the first sprinkler head placement push I" inch of the 100' roll of ¼" elongated pipe (40) illustrated in FIG. 5 into the elbow connector member (35) illustrated in FIG. 4. The sprinkler assembly within FIGS. 9 and 10 is placed at the end of the water zone. The T fitting (33) with an attached assembly is placed at a predetermine distance from the faucet (60) within the horizontal trench (65).

Kit #3 One Zone with Single Timer

This Kit is installed the same as Kit #1 except a timer is attached onto the Y fitting (16) illustrated in FIG. 1 at the port (20) or port (25). Swivel adapter (36) is attached to a single port timer (34) which is then connected to elongated pipe (40). FIG. 14 approximately illustrates this kit except a timer is attached to port (25) of Y fitting.

Kit #4 One Zone, Two Sprinkler Head with Single Timer

This kit is installed the same as Kit #2 except a timer (34) is attached onto the y fitting (16) illustrated in FIG. 1 at the port (20) or port (25). Swivel adapter (36) is attached to a timer (34) which is then connected to elongated pipe (40). FIG. 12 illustrates multiple sprinkler heads (50) installed within one zone. Alternatively this kit can be installed with single port timer (34) that interconnects directly with the backflow preventor (32) or the timer (34) can be interconnected directly to faucet (60) without any backflow preventor (32).

Kit #5 Three Zones with Three Port Timer.

This Kit supports three zones that are automatically controlled through the three port timer. The house faucet (60) Connect to the back flow preventer (32) illustrated in FIG. 1*a* that is coupled to the Y fitting (16) illustrated into FIG. 1*a*. Then the three port timer (34) illustrated in FIG. 2 is coupled to ports (20) or (25). Timer (34) ports (21, 22, and 23) are each interconnected with a poly adapter (36) which is connected to one end of elongated pipe (40) supporting each water zone. In this configuration each water zone comprises a horizontal trench (65) from the faucet (60) to each flag designating the point of placement of sprinkler (50). At each flag sprinkler assembly illustrated in FIGS. 9 and 10 are installed within a vertical trench (67). Each elbow fitting (35) interconnects with the opposite end of the elongated pipe (40) thereby completing the water zone connection coverage. FIG. 12 illustrates this Kit configuration.

Kit 6 One Zone Kit with Timer

This Kit supports a 90 square feet section area of lawn.

This kit is installed the same as Kit 3 except the pop-up sprinkler (50) is the custom sprinkler in FIG. 8*d* that rotates 360 degrees.

Kit 7 Single Timer One Zone Side Lawn Sprinkler Kit

This kit comprises five small pop up sprinkler heads (50) used to cover the side of a lawn from 60 to 75 feet in length and 5 to 10 feet in width. The kit further comprises (1) Y fitting (16); (3) elbows (35); (1) back flow preventer (32); (4) T shape couplers (33); (5) 2 inch nipples (41); and at least 100 feet of 1" inch elongated pipe (40). To install Kit 7, connect the back flow preventer (32) illustrated in FIG. 1*a* to house faucet (60). Then connect the flow member (16) in FIG. 1 to a back flow preventer (32) illustrated in FIG. 1*a*. The elongated pipe (40) illustrated in FIG. 5 is segmented into multiple sections to support the length of the lawn. Each sprinkler supports about 12 feet of lawn and is placed within a vertical trench (67) interconnected with a T Coupler (33). As shown in FIG. 12, the plurality of T couplers (33) illustrated in FIG. 4*a* are placed within vertical trenches (67) along the horizontal trench (65) perpendicularly aligned therewith. Each small sprinkler (50) is interconnected with the elongated pipe (40) to support multiple sections of the lawn.

FIGS. 15(*a*) and 15(*b*) illustrates coverage of various sections of lawns. FIG. 15(*b*) illustrates multiple there zones each supported by two sprinklers (50). In FIG. 15*b* zone 1 has two sprinklers (50) covering 200 and 240 feet lawn coverage; zone 2 has two sprinklers (50) covering 120 and 160 feet zones; and zone 3 has two sprinklers (50) covering 120 and 160 feet zones. In FIG. 15*a* zone 1 has one sprinkler (50) covering 40 feet of lawn coverage; zone 2 has one sprinkler (50) covering 80 feet zone; and zone 3 has one sprinkler (50) covering 120 feet zone.

What is claimed is:

1. A lawn sprinkler system in combination with underground trenches for connection to an above ground water supply located near a building structure allowing for watering of an area of a lawn located exterior to the building structure, comprising:

a sprinkler device positioned a pre-determined distance from the building structure within a vertical trench extending a pre-determined vertical depth below ground level to support a predetermined water zone within the area of the lawn;

a riser shaft operationally connected within the sprinkler device;

an elongated pipe member defined by a front end and a back end; the elongated pipe member seated within a horizontal underground trench separate from the underground water main supply trench extending from the above ground water supply to the pre-determined vertical depth below the sprinkler device;

a coupler mechanism situated below the sprinkler device interconnecting a bottom end of the sprinkler device with the back end of the elongated pipe member; and a flow control meter interconnecting the front end of the elongated pipe member with the above ground water supply;

wherein the horizontal underground trench is located a pre-determined shallow distance below ground level;

wherein the pre-determined vertical depth is greater than the shallow pre-determined distance wherein a tapering trench is diagonally disposed below ground level interconnecting the vertical trench with the horizontal underground trench; and wherein the sprinkler device consisting of a base unit with a pipe member that is operationally coupled to the riser shaft with a pop-up water emitter such that when the riser shaft telescopes upward, the pop-up water emitter disperses water onto the predetermined water zone of the lawn area;

one or more piping couplers disposed between the bottom end of the sprinkler device and the coupler mechanism for interconnecting the coupler mechanism to the sprinkler device wherein a constant water supply is maintained between distance above ground water supply to the sprinkler device through the elongated pipe member;

a T shape coupler;

wherein the T shape coupler is disposed a distance from the above ground water supply within a second vertical trench perpendicularly aligned with the horizontal underground trench wherein smaller sections of the elongated pipe are within a second underground horizontal trench beyond the horizontal trench forming another zone within the lawn.

2. The system of claim 1, wherein the shallow pre-determined distance is at least 2 inches.

3. The system of claim 1, wherein the pre-determined distance is at least 7 feet.

4. The system of claim 1, wherein the pre-determined vertical depth is at least 17 inches.

5. The system of claim 1, wherein the tapering trench is at least 20 inches.

6. The system of claim 1, wherein the tapering trench is at least 10 inches.

7. The system of claim 1, wherein the flow control meter further comprises a switch for selecting between water zones.

8. The system of claim 1, wherein the coupler mechanism is an elbow coupler situated within the vertical trench.

9. The system of claim 1, wherein the flow control meter further comprises a backflow preventer mechanism for operationally interconnecting with the above ground water supply to prevent back water flow.

10. The system of claim 1, wherein the pop-up water emitter further comprises a 360-degree rotating valve.

11. The system of 29, wherein the pop-up water emitter is a device selected from the group consisting of a single jet stream port, one or more jet stream ports, or a plurality of water outlet ports dispersing a stream of water.

12. The system of claim 1, wherein the flow control member further comprising a timer mechanism which automatically controls the switching between the one or more water zone.

13. A method for watering a lawn using the lawn sprinkler system of claim 1 comprising the steps of:

providing a sprinkler device positioned a zone pre-determined distance from the building structure within a vertical trench extending a pre-determined vertical depth below ground level to support a zone within the area of the lawn;

providing an elongated pipe member seated within in a horizontal underground trench located a shallow pre-determined distance below ground level extending from the above ground water supply to a pre-determined tapering distance away from the zone pre-determined distance;

interconnecting the above ground water supply to the sprinkler device to supply fluid communication therewith with the elongated pipe member;

creating a tapering trench extending diagonally from the tapering pre-determined distance the pre-determined depth of the vertical trench; and interconnecting a bottom end of the sprinkler device with the elongated pipe member using a coupler member situated within the tapering trench.

14. The method of claim 13, further comprising controlling the flow of water from the above grown water supply to one or more zones within the lawn area.

15. The method of claim 14, wherein the controlling step further comprising automatically switching between zones of the lawn.

16. A kit for creating an underground water sprinkler system for a lawn, comprising:

a pop-up sprinkler consisting of a base unit with a telescoping sprinkler head with at least one outlet to emit water, the pop-up sprinkler is disposed for installation within a vertical underground trench;

a flow control member for switching between one or more water zones, the flow control member operationally connected with an above ground outdoor water supply;

an elongated pipe supporting the one or more water zones of the lawn and lying within an underground horizontal trench a shallow predetermined distance below ground level and extending laterally between the above ground water supply and the pop-up sprinkler; and an elbow coupler situated below the pop-up sprinkler for interconnecting the pop-up sprinkler with the elongated pipe, the elbow coupler situated within the vertical underground trench extending between the underground horizontal trench and a lower end of the vertical trench disposed beneath the base unit; the elongated pipe interconnecting the flow control member to the coupler;

wherein one end of the elongated pipe is connected with the coupler and an opposite end of the elongated pipe connected with the flow control member; and wherein one or more piping couplers are interconnecting the elbow coupler to a lower end of the pop-up sprinkler, wherein a constant water supply is maintained between the above ground water supply to the pop-up sprinkler through the elongated pipe;

one or more piping couplers disposed between the bottom end of the sprinkler device and the coupler mechanism for interconnecting the coupler mechanism to the sprinkler device wherein a constant water supply is maintained between distance above ground water supply to the sprinkler device through the elongated pipe member;

a T shape coupler;

wherein the T shape coupler is disposed a distance from the above ground water supply within a second vertical trench perpendicularly aligned with the horizontal underground trench wherein smaller sections of the elongated pipe are within a second underground horizontal trench beyond the horizontal trench forming another zone within the lawn.

* * * * *